US012680775B2

(12) United States Patent
Couvillion

(10) Patent No.: US 12,680,775 B2
(45) Date of Patent: Jul. 14, 2026

(54) TRIGGER FRAME ASSEMBLY

(71) Applicant: Zenith Firearms, Inc., Afton, VA (US)

(72) Inventor: Roy J. Couvillion, Lafayette, LA (US)

(73) Assignee: Zenith Firearms, Inc., Afton, VA (US)

( * ) Notice: Subject to any disclaimer, the term of this patent is extended or adjusted under 35 U.S.C. 154(b) by 269 days.

(21) Appl. No.: 18/152,873

(22) Filed: Jan. 11, 2023

(65) Prior Publication Data

US 2024/0230263 A1 Jul. 11, 2024

(51) Int. Cl.
*F41A 19/10* (2006.01)

(52) U.S. Cl.
CPC ..... *F41A 19/10* (2013.01)

(58) Field of Classification Search
CPC ..... F41A 19/10; F41A 11/00; F41A 3/66
See application file for complete search history.

(56) References Cited

U.S. PATENT DOCUMENTS

2015/0013201 A1* 1/2015 Hannan ..... F41A 19/01 42/20
2020/0096275 A1* 3/2020 Geissele ..... F41A 17/46

* cited by examiner

*Primary Examiner* — J. Woodrow Eldred
(74) *Attorney, Agent, or Firm* — Christopher B. Kilner; MILLEN, WHITE, ZELANO & BRANIGAN, P.C.

(57) ABSTRACT

A trigger frame assembly that is received within a grip of a firearm for use in providing a housing for a plurality of internal action component parts of a firearm, such as, a trigger. A trigger frame assembly comprising a plurality of panel members that are braced and connected together via a plurality of mechanical fasteners, or an interlocking snapping mechanism, that allow the panel members to fit firmly together, wherein the mechanical fasteners also allow the panel members to be disassembled, as necessary, thereby allowing for easier replacement and configuration of the panel members and the internal action component parts of the firearm.

8 Claims, 8 Drawing Sheets

TRIGGER FRAME ASSEMBLY

CROSS REFERENCES TO RELATED APPLICATION

Priority of U.S. Provisional Patent Application Ser. No. 63/298,672, filed Jan. 12, 2022, incorporated herein by reference, is hereby claimed.

STATEMENTS AS TO THE RIGHTS TO THE INVENTION MADE UNDER FEDERALLY SPONSORED RESEARCH AND DEVELOPMENT

NONE

BACKGROUND OF THE INVENTION

Field of the Invention

The present invention pertains to a trigger frame assembly that is received within a grip of a firearm for use in providing a housing for a plurality of internal action component parts of said firearm. More particularly, the trigger frame assembly of the present invention comprises a plurality of panel members that are attachably connected and braced and/or welded together by way of a plurality of mechanical fasteners, or an interlocking snapping mechanism, that allows for easy assembly and disassembly of said panel members, thereby allowing for easier replacement and service to the component parts of said firearm and to said panel members of said trigger frame assembly.

Brief Description of the Prior Art

Generally, a trigger assembly within a firearm comprises a trigger frame, which is used and adapted to receive a trigger and a variety of other internal component parts of a firearm. The trigger frame is received within the firearm and forms part of the firearm itself. A trigger frame secures and holds in proper place a plurality of component parts for a firearm, including, but not limited to, a trigger body, a sear sub-assembly, a trigger spring, a trigger crank sub-assembly, a safety selector, a hammer sub-assembly, an ejector, an ejector spring, a release lever sub-assembly and a plurality of supportive pieces for each component part.

A conventional trigger frame method generally comprises stamped sheet steel, wherein said trigger frame requires stamping, bending, folding, welding, brazing & multiple attachment pieces which are turned, welded, and brazed together on to the stamped sheet steel in order to acquire a finished trigger frame.

SUMMARY OF THE PRESENT INVENTION

While the present invention will be described with reference to preferred embodiments, it will be understood by those skilled in the art that various changes may be made and equivalents may be substituted for elements thereof without departing from the scope of the present invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof).

The present invention pertains to a trigger frame assembly for use in providing a housing for a plurality of internal action component parts of a firearm. More particularly, the present invention pertains to a trigger frame assembly that can provide higher tolerances, increased precision, and more serviceability and/or repair to a firearm. An additional benefit of the present invention is that it is easy to manufacture. As a result, if a replacement part of said trigger frame assembly is needed, the present invention allows for a faster and easier means of repair.

In a preferred embodiment, said trigger frame assembly of the present invention generally comprises an internal frame member defining a housing structure that is removeable from a firearm. Said internal frame member generally comprises a plurality of panels that are braced and connected together via a plurality of mechanical fasteners, or an interlocking snapping mechanism. In this regard, said panels of said internal frame member comprise a substantially planar front member, a substantially planar back member, and a plurality of—at least two (2)—substantially planar side members. Said front member and said back member are oriented substantially parallel to each other, while said side members are oriented substantially parallel to each other; thus, said front, said back, and said sides cooperate to form an inner space or chamber for receiving a plurality of other mating parts for a firearm.

In a preferred embodiment, said sides, said front, and said back are braced and connected together via mechanical fasteners, or any other similar attachment means. Said mechanical fasteners comprise an interlocking snapping mechanism, wherein said front member is able to snap and connect directly to a first end of both side members, and said back member is able to snap and connect directly to a second end of both side members. As such, when each component part is engaged, the parts must fit firmly together, yet be able to be disassembled, as necessary. As a result of said interlocking snapping mechanism, if a component part needs to be replaced, the trigger frame assembly can be removed from the firearm, and the appropriate component part can be disassembled, removed, and then replaced. The entire trigger frame assembly can then be reinserted into the firearm.

As a result, in a preferred embodiment, said trigger frame assembly of the present invention allows for easier manufacturing, easier configurability, and easier serviceability due to said interlocking snapping mechanism that enables quicker and easier disassembly and replaceability of any component parts of the present invention.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

The present invention comprises a trigger frame assembly 100 generally comprising an internal frame member 10 and a connecting mechanism 20. Said internal frame member 10 can be manufactured from a substantially strong, yet light weight metal material, such as, for example, AISI 4140 per ASTM A29 alloy steel, or any other similar metal material exhibiting like characteristics, wherein said alloy steel material is used for providing a frame and structure to said trigger assembly 100. As such, the alloy steel material of said internal frame member 10 creates an extremely strong and rigid structure in order to withstand an amount of force applied to said trigger frame assembly 100 during operation and utilization of a firearm, thus allowing for good balance of strength, toughness, abrasion and impact resistance, and heat treatment capabilities.

Figure 1:
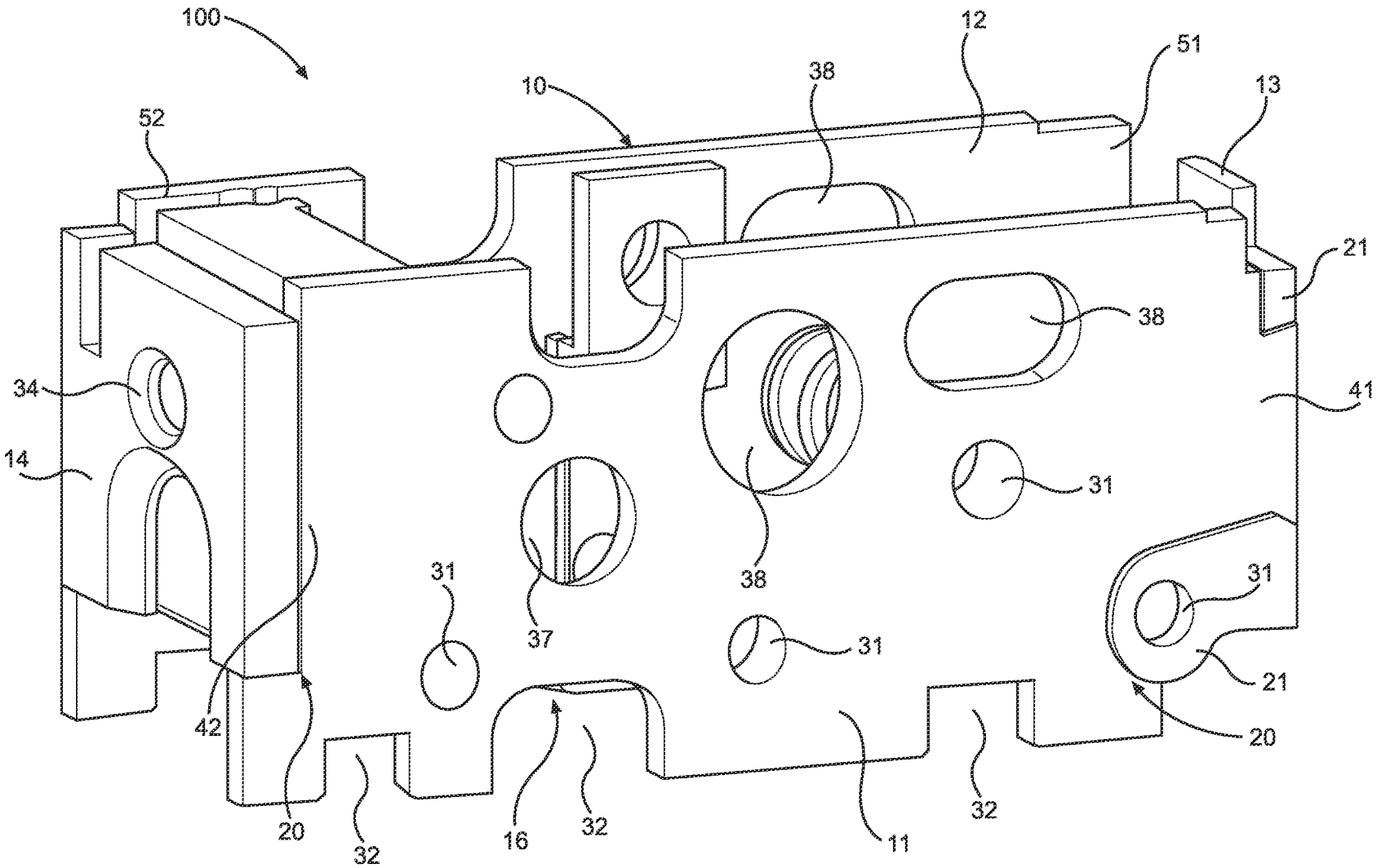
FIG. 1 depicts a side perspective view of a preferred embodiment of a trigger frame assembly of the present invention.

Referring to the drawings, FIG. 1 depicts a side perspective view of a preferred embodiment of a trigger frame assembly 100 of the present invention. Trigger frame assembly 100 generally comprises internal frame member 10 and connecting mechanism 20. Internal frame member comprises a first side panel member 11, a second side panel member 12, a front panel member 13, and a back panel member 14, wherein said side panel members 11, 12 are oriented in a parallel configuration relative to each other, and wherein said front panel member 13 and said back panel member 14 are oriented in a parallel configuration relative to each other. As such, said side panel members 11, 12, said front panel member 13, and said back panel member 14 cooperate to form an inner cavity or chamber 16.

First side panel member 11 comprises a first end 41 and a second end 42. First end 41 of first side panel member 11 attachably connects to front panel member 13 via connecting mechanism 20, wherein second end 42 of first side panel member 11 attachably connects to back panel member 14 via connecting mechanism 20. In addition, second side panel member 12 comprises a first end 51 and a second end 52. First end 51 of second side panel member 12 attachably connects to front panel member 13 via connecting mechanism 20, wherein second end 52 of second side panel member 12 attachably connects to back panel member 14 via connecting mechanism 20.

Still referring to the drawings, connecting mechanism 20 comprises a plurality of mechanical fasteners 21 that attachably connect said side panel members 11, 12 of internal frame member 10 to both said front panel member 13 and said back panel member 14 by way of snapping each of said panel members together. For example, in a preferred embodiment, front panel member 13 snaps into first end 41 of first side panel member 11 and into first end 51 of second side panel member 12 and attachably connects by way of said mechanical fasteners 21, thereby securing said front panel member 13 into place. Additionally, in a preferred embodiment, back panel member 14 snaps into second end 42 of first side panel member 11 and into second end 52 of second side panel member 12 and attachably connects by way of said mechanical fasteners 21, thereby securing said back panel member 14 into place.

Still referring to FIG. 1, said first side panel member 11 and said second side panel member 12 each comprise a plurality of through bores 31 that allow for connection to various other component parts of said firearm. Said component parts of said firearm can attachably connect and snap into said through bores 31, thereby securing said component parts into place. As illustrated in FIG. 1, first side panel 11 and second side panel 12 each also comprise a through bore 37 that allows for the connection of a safety selector and also comprise a plurality of through bores 38 that allow for various internal component parts of a firearm to be connected in and through internal frame member 10 of trigger frame assembly. Additionally, said first side panel member 11 and said second side panel member 12 each comprise a plurality of notches 32 that allow for trigger frame assembly 100 to be connected to and secured within a firearm grip 5 once said trigger frame assembly 100 is received within said firearm grip 5.

In a preferred embodiment, when trigger frame assembly 100 of the present invention is assembled, internal frame member 10 will necessarily have substantially small spaces between side panel members 11, 12 and front panel member 13 and back panel member at the connection points. When said underlying firearm is in use, forces applied to said panel members 11, 12, 13, and 14 of said internal frame member 10 will cause said panel members 11, 12, 13, and 14 to move with respect to each other. The panel members will repeatedly impact each other and material deformation will eventually occur at those points. As such, trigger frame assembly 100 of the present invention comprises physical features which facilitate adding material to fill the substantially small spaces between the panel members. Capillary action causes said filler material to propagate through microscopic voids and provide continuous support throughout internal frame member 10.

As a result, in a preferred embodiment, once internal frame member 10 is attachably connected by way of mechanical fasteners 21 of connecting mechanism 20, trigger frame assembly 100 of the present invention is then designed to be held together by way various attachment means, such as, for example, by brazing or use of an adhesive (for example, Loctite®, or any other similar adhesive illustrating like characteristics).

Figure 2:
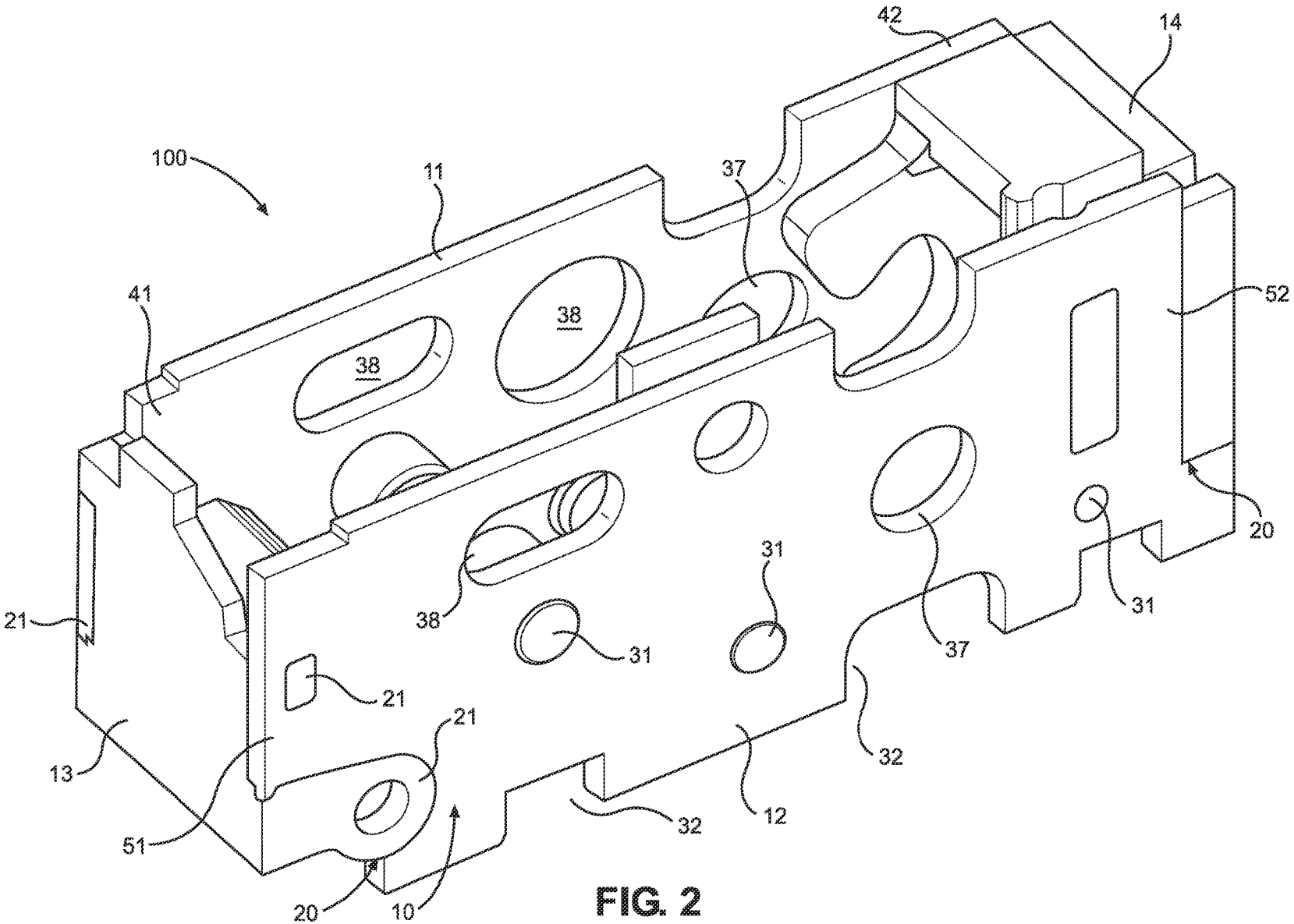
FIG. 2 depicts a perspective view of a preferred embodiment of a trigger frame assembly of the present invention.

FIG. 2 depicts a perspective view of a preferred embodiment of trigger frame assembly 100 of the present invention, generally comprising internal frame member 10 and interlocking connecting mechanism 20. Internal frame member comprises first side panel member 11, second side panel member 12, front panel member 13, and back panel member 14, wherein said side panel members 11, 12 are oriented in a parallel configuration relative to each other, and wherein said front panel member 13 and said back panel member 14 are oriented in a parallel configuration relative to each other. As such, said side panel members 11, 12, said front panel member 13, and said back panel member 14 cooperate to form inner cavity or chamber 16.

In a preferred embodiment, first side panel member 11 comprises first end 41 and second end 42. First end 41 of first side panel member 11 attachably connects to front panel member 13 via connecting mechanism 20, wherein second end 42 of first side panel member 11 attachably connects to back panel member 14 via connecting mechanism 20. In addition, second side panel member 12 comprises first end 51 and second end 52. First end 51 of second side panel member 12 attachably connects to front panel member 13 via connecting mechanism 20, wherein second end 52 of second side panel member 12 attachably connects to back panel member 14 via connecting mechanism 20.

Still referring to FIG. 2, connecting mechanism 20 comprises mechanical fasteners 21 that attachably connect said side panel members 11, 12 of internal frame member 10 to both said front panel member 13 and said back panel member 14 by way of snapping each of said panel members together. For example, in a preferred embodiment, front panel member 13 snaps into first end 41 of first side panel member 11 and into first end 51 of second side panel member 12 and attachably connects by way of said mechanical fasteners 21, thereby securing said front panel member 13 into place. Additionally, in a preferred embodiment, back panel member 14 snaps into second end 42 of first side panel member 11 and into second end 52 of second side panel member 12 and attachably connects by way of said mechanical fasteners 21, thereby securing said back panel member 14 into place. Interlocking connecting mechanism 20 with mechanical fasteners 21 thus allows trigger frame assembly 100 to be disassembled and reassembled in a relatively easy and efficient manner, thereby allowing for any internal component part within trigger frame assembly 100 to be replaced, as necessary, without deconstructing the entirety of a firearm.

As depicted in FIG. 2, said first side panel member 11 and said second side panel member 12 each comprise through bores 31 that allow for connection to various other component parts of said firearm. Said component parts of said firearm can attachably connect and snap into said through bores 31, thereby securing said component parts into place. Additionally, said first side panel member 11 and said second side panel member 12 each comprise notches 32 that allow for trigger frame assembly 100 to be connected to and secured within a firearm grip 5 once said trigger frame assembly 100 is received within said firearm grip 5.

Figure 3:
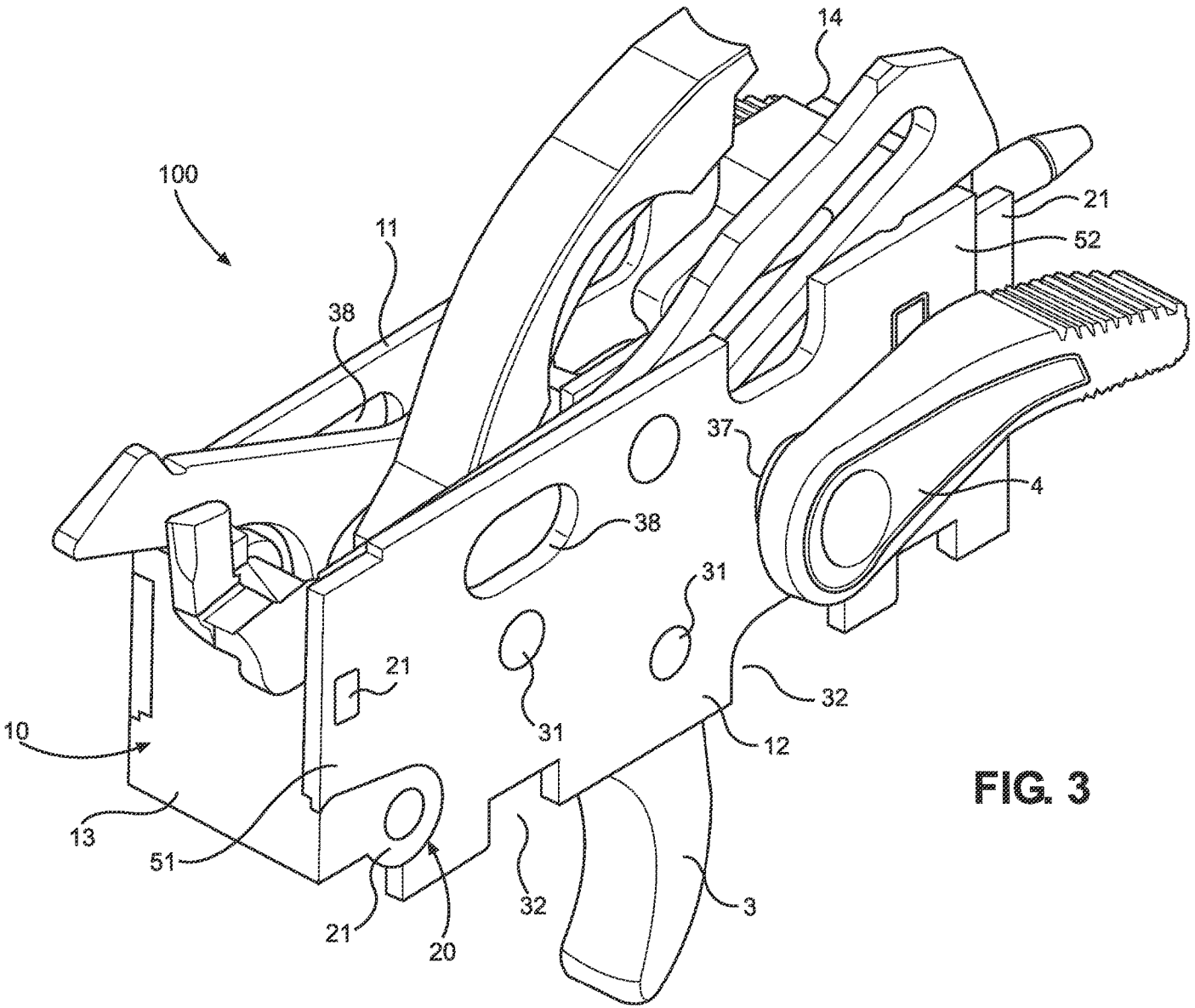
FIG. 3 depicts a perspective view of a preferred embodiment of a trigger frame assembly of the present invention comprising a plurality of mating parts filled within said trigger frame assembly.
Figure 4:
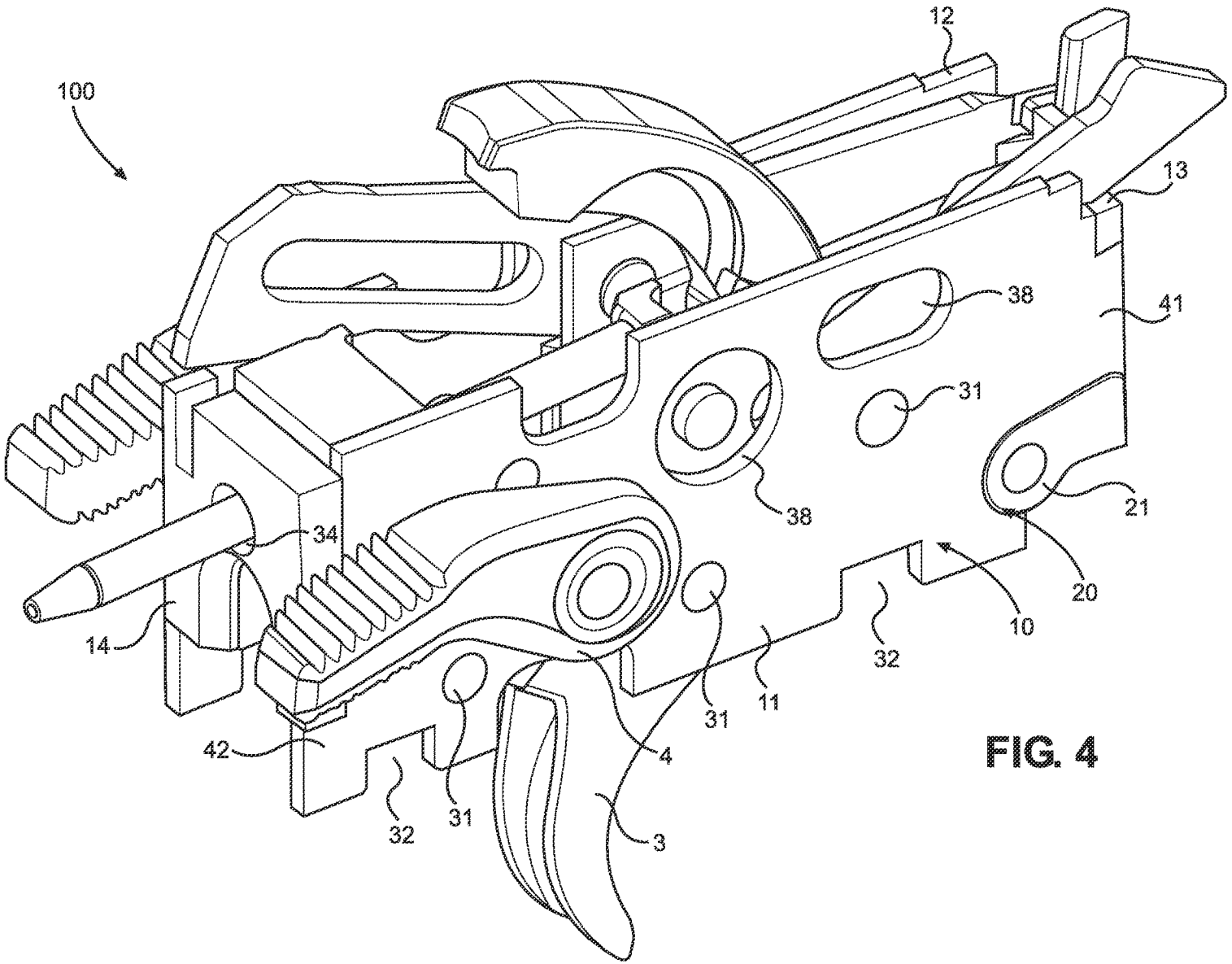
FIG. 4 depicts an alternate perspective view of a preferred embodiment of a trigger frame assembly of the present invention comprising a plurality of mating parts filled within said trigger frame assembly.
Figure 7:
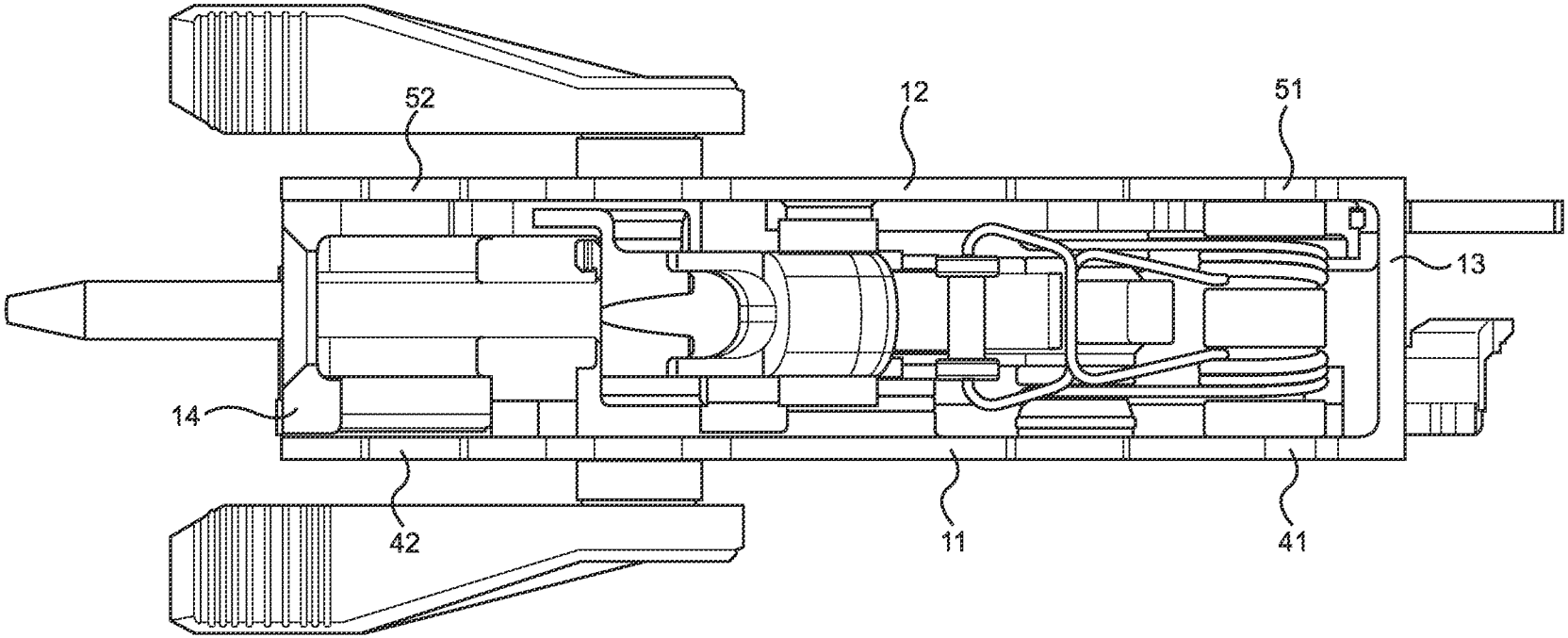
FIG. 7 depicts a bottom view of a preferred embodiment of a trigger frame assembly of the present invention comprising a plurality of mating parts filled within said trigger frame assembly.

FIG. 3 depicts a perspective view of a preferred embodiment of trigger frame assembly 100 of the present invention comprising a plurality of internal action parts of a firearm received within said trigger frame assembly 100. FIG. 4 depicts an alternate perspective view of a preferred embodiment of trigger frame assembly 100 of the present invention comprising a plurality of internal action parts of said firearm received within said trigger frame assembly 100. Additionally, FIG. 7 depicts a bottom view of a preferred embodiment of trigger frame assembly 100 of the present invention comprising a plurality of internal component parts received within said trigger frame assembly 100.

As illustrated in the drawings, connecting mechanism 20 comprises mechanical fasteners 21 that attachably connect said side panel members 11, 12 of internal frame member 10 to both said front panel member 13 and said back panel member 14 by way of snapping each of said panel members together. For example, front panel member 13 snaps into first end 41 of first side panel member 11 and into first end 51 of second side panel member 12 and attachably connects by way of said mechanical fasteners 21, thereby securing said front panel member 13 into place. Additionally, back panel member 14 snaps into second end 42 of first side panel member 11 and into second end 52 of second side panel member 12 and attachably connects by way of said mechanical fasteners 21, thereby securing said back panel member 14 into place. As a result, side panel members 11, 12, said front panel member 13, and said back panel member 14 attachably snap together by way of mechanical fasteners 21 of interlocking connecting mechanism 20, and thus, cooperate to form inner cavity or chamber 16.

Inner chamber 16 of trigger frame assembly 100 allows for a variety of internal component parts (such as, for example, a trigger, a trigger body, a sear sub-assembly, a trigger spring, a trigger crank sub-assembly, a safety selector, a hammer sub-assembly, an ejector, an ejector spring, a release lever sub-assembly and a plurality of supportive pieces for each internal component part) of a firearm to be received within trigger frame assembly 100. As illustrated in FIGS. 3 and 4, first side panel 11 and second side panel 12 comprise through bores 37 that allow for the connection of a safety selector and also comprise through bores 38 that allow for various internal component parts of a firearm to be connected in and through internal frame member 10 of trigger frame assembly. As such, trigger frame assembly 100 holds and secures said component parts of said firearm. If a component part of a firearm needs to be replaced or repaired, a user can remove trigger frame assembly 100 in its entirety from firearm grip 5. Said user can then disassemble trigger frame assembly 100 in order to remove and replace the component part at issue. Once the component part has been replaced and trigger frame assembly 100 has been reconnected, trigger frame assembly 100 can then be reinserted into firearm grip 5.

As a result, interlocking connecting mechanism 20 with mechanical fasteners 21 thus allows trigger frame assembly 100 to be disassembled and reassembled in a relatively easy and efficient manner, thereby allowing for any internal component part within trigger frame assembly 100 to be replaced or repaired, as necessary, without deconstructing the entirety of a firearm.

Figure 5:
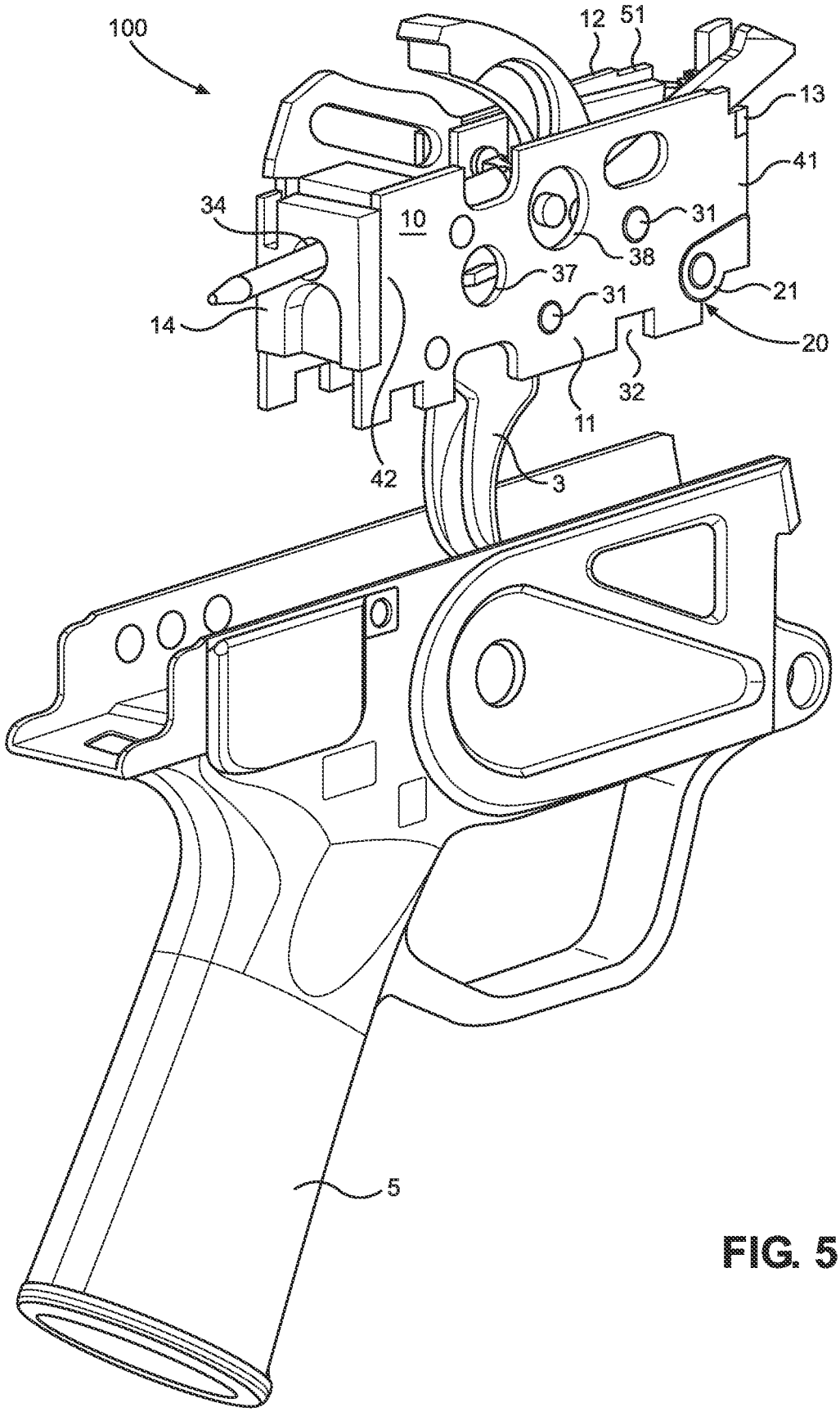
FIG. 5 depicts a perspective view of a preferred embodiment of a trigger frame assembly of the present invention comprising a plurality of mating parts filled within said trigger frame assembly and wherein said trigger frame assembly is being inserted into a firearm grip.
Figure 6:
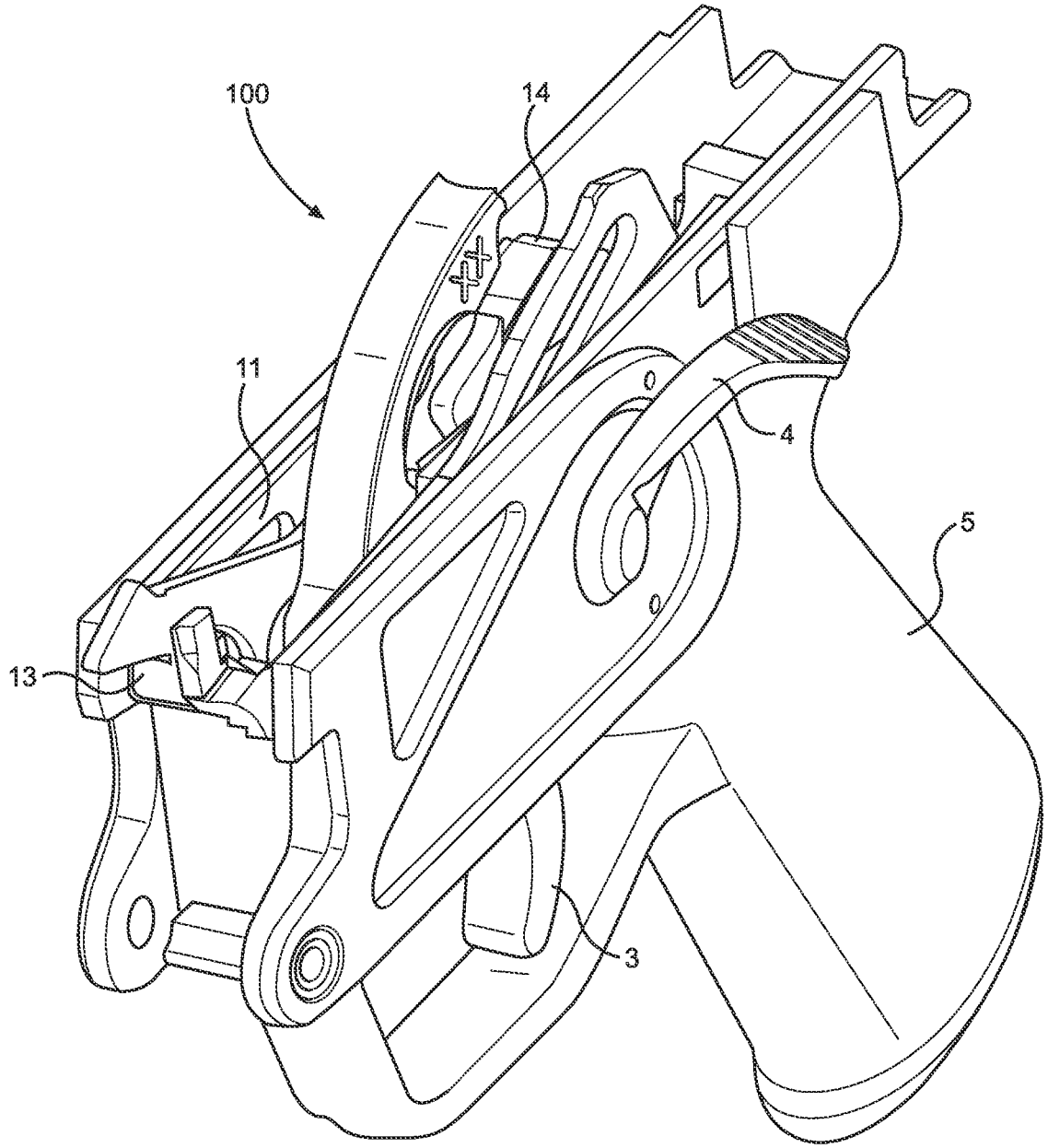
FIG. 6 depicts a perspective view of a preferred embodiment of a trigger frame assembly of the present invention comprising a plurality of mating parts filled within said trigger frame assembly and wherein said trigger frame assembly is inserted within a firearm grip.

Referring back to the drawings, FIG. 5 depicts a perspective view of a preferred embodiment of trigger frame assembly 100 of the present invention comprising a trigger 3 and a plurality of other internal action parts received within said trigger frame assembly 100 and wherein said trigger frame assembly 100 is being inserted into firearm grip 5. In addition, FIG. 6 depicts a perspective view of a preferred embodiment of trigger frame assembly 100 of the present invention comprising a plurality of internal component parts filled within said trigger frame assembly 100 and wherein said trigger frame assembly 100 is inserted within firearm grip 5.

Trigger frame assembly 100 generally comprises internal frame member 10 and interlocking connecting mechanism 20, wherein first side panel member 11, second side panel member 12, front panel member 13, and back panel member 14 of internal frame member 10 are attachably connected together via mechanical fasteners 21 of connecting mechanism 20. As such, side panel members 11, 12, front panel member 13, and back panel member 14 are snapped together by way of mechanical fasteners 21, and cooperate together to form inner cavity 16.

As depicted in FIG. 5, once attachably connected together, trigger frame assembly 100 can then receive and hold a variety of internal component parts, such as, for example, trigger 3, of a firearm within inner cavity 16. Said trigger 3 and said internal component parts of said firearm are connected and secured to internal frame member 10 of trigger frame assembly 100 by way of said through bores 31. Additionally, as depicted in FIG. 6, once trigger 3 and said internal component parts are secured within trigger frame assembly 100, trigger frame assembly 100 is then inserted into and received within firearm grip 5, thus keeping said trigger 3 and said internal components parts in place within firearm grip 5.

In a preferred embodiment, if trigger 3 or another internal component part of a firearm needs to be replaced or repaired, a user can remove trigger frame assembly 100 in its entirety from firearm grip 5. Said user can then disassemble internal frame member 10 of trigger frame assembly 100 in order to remove and replace the internal component part at issue. Once the component part has been replaced and internal frame member 10 of trigger frame assembly 100 has been reconnected by way of mechanical fasteners 21 of connecting mechanism 20, trigger frame assembly 100, along with trigger 3 and the various other component parts, can then be reinserted into firearm grip 5.

Figure 8:
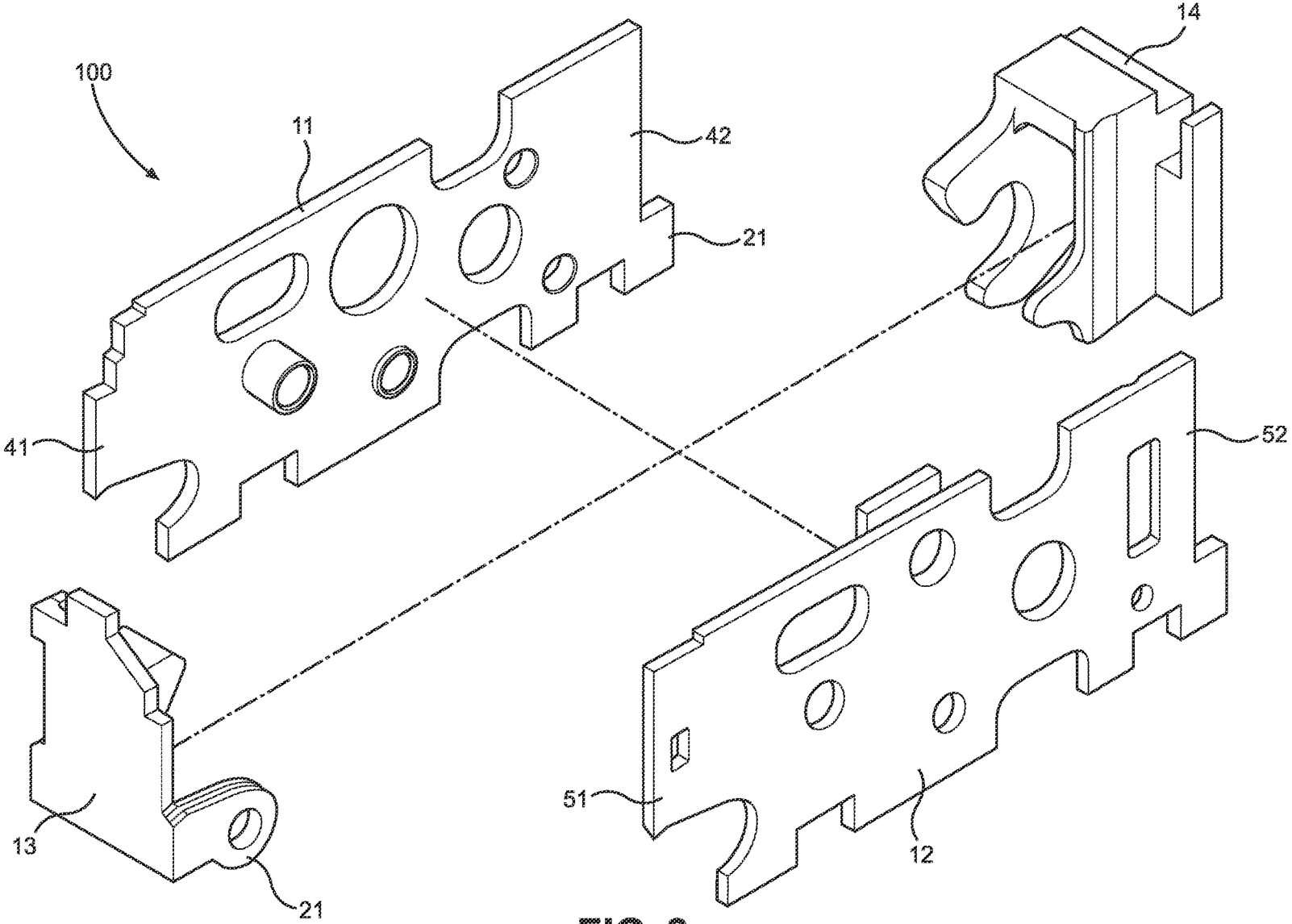
FIG. 8 depicts an exploded side perspective view of a preferred embodiment of a trigger frame assembly of the present invention.

FIG. 8 depicts an exploded side perspective view of trigger frame assembly 100 of the present invention, generally comprising internal frame member 10 and interlocking connecting mechanism 20. Internal frame member comprises first side panel member 11, second side panel member 12, front panel member 13, and back panel member 14, wherein said side panel members 11, 12 are oriented in a parallel configuration relative to each other, and wherein said front panel member 13 and said back panel member 14 are oriented in a parallel configuration relative to each other. As such, said side panel members 11, 12, said front panel member 13, and said back panel member 14 cooperate to form inner cavity or chamber 16.

In a preferred embodiment, first side panel member 11 comprises first end 41 and second end 42. As depicted in FIG. 8, first end 41 of first side panel member 11 attachably connects to front panel member 13 via connecting mechanism 20, wherein second end 42 of first side panel member 11 attachably connects to back panel member 14 via connecting mechanism 20. In addition, second side panel member 12 comprises first end 51 and second end 52. As illustrated in FIG. 8, first end 51 of second side panel member 12 attachably connects to front panel member 13 via connecting mechanism 20, wherein second end 52 of second side panel member 12 attachably connects to back panel member 14 via connecting mechanism 20.

Still referring to FIG. 8, connecting mechanism 20 comprises mechanical fasteners 21 that attachably connect said side panel members 11, 12 of internal frame member 10 to both said front panel member 13 and said back panel member 14 by way of snapping each of said panel members together. For example, in a preferred embodiment, front panel member 13 snaps into first end 41 of first side panel member 11 and into first end 51 of second side panel member 12 and attachably connects by way of said mechanical fasteners 21, thereby securing said front panel member 13 into place. Additionally, in a preferred embodiment, back panel member 14 snaps into second end 42 of first side panel member 11 and into second end 52 of second side panel member 12 and attachably connects by way of said mechanical fasteners 21, thereby securing said back panel member 14 into place. Interlocking connecting mechanism 20 with mechanical fasteners 21 thus allows trigger frame assembly 100 to be disassembled and reassembled in a relatively easy and efficient manner, thereby allowing for any internal component part within trigger frame assembly 100 to be replaced, as necessary, without deconstructing the entirety of a firearm.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A trigger frame assembly for use in housing and securing a plurality of internal action component parts of a firearm, comprising:

a) an internal frame member having a first side panel member, a second side panel member, a front panel member, and a back panel member, wherein said first side panel member, said second side panel member, said front panel member, and said back panel member are separate members that cooperate to form an inner reservoir; and b) an interlocking connecting mechanism, wherein said interlocking connecting mechanism comprises a plurality of mechanical fasteners located on each of said first side panel member, said second side panel member, said front panel member, and said back panel member, wherein respective mechanical fasteners on adjacent panel members are configured to snap together to attachably connect and brace said first side panel member to said front panel member and said back panel member and attachably connect said second side panel member to said front panel member and said back panel member.

2. The apparatus of claim 1, wherein:

a) said first side panel member comprises a first end and a second end, wherein said first end of said first side panel member attachably connects to said front panel member and said second end of said first side panel member attachably connects to said back panel member; and b) said second side panel member comprises a first end and a second end, wherein said first end of said second side panel member attachably connects to said front panel member and said second end of said second side panel member attachably connects to said back panel member.

3. The apparatus of claim 2, further comprising a plurality of through bores located on both said first side panel member and said second side panel member for receiving and connecting said internal component parts of said firearm within said inner reservoir of said internal frame member.

4. The apparatus of claim 3, further comprising a plurality of notches located on bottom edges of each of said first side panel member, said second side panel member, and said back panel member for attachably connecting said internal frame member of said trigger frame assembly into said firearm.

5. A method of housing and securing a plurality of internal component parts of a firearm, comprising:

a) attachably connecting a trigger frame assembly, wherein said trigger frame assembly comprises:

1. An internal frame member having a first side panel member, a second side panel member, a front panel member, and a back panel member, wherein said first side panel member, said second side panel member, said front panel member, and said back panel member are separate members that cooperate to form an inner reservoir;

2. An interlocking connecting mechanism, wherein said interlocking connecting mechanism comprises a plurality of mechanical fasteners located on each of said first side panel member, said second side panel member, said front panel member, and said back panel member, wherein respective mechanical fasteners on adjacent panel members are configured to snap together to attachably connect and brace said first side panel member to said front panel member and said back panel member and attachably connect said second side panel member to said front panel member and said back panel member;

b) inserting said internal component parts of said firearm within said inner reservoir of said internal frame member;

c) attachably connecting said internal component parts of said firearm to said internal frame member by way of a plurality of through bores; and d) inserting said trigger frame assembly into a firearm grip of said firearm.

6. The method of claim 5, wherein:

a) said first side panel member comprises a first end and a second end, wherein said first end of said first side panel member attachably connects to said front panel member and said second end of said first side panel member attachably connects to said back panel member; and b) said second side panel member comprises a first end and a second end, wherein said first end of said second side panel member attachably connects to said front panel member and said second end of said second side panel member attachably connects to said back panel member.

7. The method of claim 6, wherein said plurality of through bores are located on both said first side panel member and said second side panel member for use in receiving and connecting said internal component parts of said firearm within said inner reservoir of said internal frame member.

8. The method of claim 7, further comprising a plurality of notches located on bottom edges of each of said first side panel member, said second side panel member, and said back panel member for attachably connecting said internal frame member of said trigger frame assembly into said firearm.

* * * * *